US008534644B2

(12) United States Patent
Lundgreen et al.

(10) Patent No.: US 8,534,644 B2
(45) Date of Patent: Sep. 17, 2013

(54) QUICK-ATTACH STEAM DISPERSION TUBES AND METHOD OF ATTACHMENT

(75) Inventors: James M. Lundgreen, Lakeville, MN (US); Jeffrey Martin Horejsi, Montgomery, MN (US)

(73) Assignee: DRI-STEEM Corporation, Eden Prairie, MN (US)

( * ) Notice: Subject to any disclaimer, the term of this patent is extended or adjusted under 35 U.S.C. 154(b) by 1362 days.

(21) Appl. No.: 12/009,134

(22) Filed: Jan. 16, 2008

(65) Prior Publication Data

US 2009/0179337 A1 Jul. 16, 2009

(51) Int. Cl.
*B01F 3/04* (2006.01)

(52) U.S. Cl.
USPC ..... 261/118; 261/DIG. 76; 239/600

(58) Field of Classification Search
USPC ..... 261/118, DIG. 15, DIG. 76; 239/600
See application file for complete search history.

(56) References Cited

U.S. PATENT DOCUMENTS

| | | | |
|---|---|---|---|
| 903,150 | A | 11/1908 | Braemer |
| 1,101,902 | A | 6/1914 | Braemer |
| 2,963,284 | A | 12/1960 | Bradford |
| 3,096,817 | A | 7/1963 | McKenna |
| 3,215,416 | A | 11/1965 | Liben |
| 3,268,435 | A | 8/1966 | Sellin |
| 3,386,659 | A | 6/1968 | Rea |
| 3,443,559 | A | 5/1969 | Pollick |
| 3,486,697 | A | 12/1969 | Fraser |
| 3,635,210 | A | 1/1972 | Morrow |
| 3,857,514 | A | 12/1974 | Clifton |
| 3,870,484 | A | 3/1975 | Berg |
| 3,923,483 | A | 12/1975 | Hilmer et al. |
| 3,955,909 | A | 5/1976 | Craig et al. |
| 4,257,389 | A | 3/1981 | Texidor et al. |
| 4,265,840 | A | 5/1981 | Bahler |
| 4,384,873 | A | 5/1983 | Herr |
| 4,913,856 | A | 4/1990 | Morton |
| 4,967,728 | A | 11/1990 | Dueck |
| 5,126,080 | A | 6/1992 | Morton et al. |
| 5,277,849 | A | 1/1994 | Morton et al. |

(Continued)

FOREIGN PATENT DOCUMENTS

| | | |
|---|---|---|
| DE | 25 29 057 | 2/1977 |
| GB | 1 444 992 | 10/1972 |
| WO | WO 00/57112 | 9/2000 |
| WO | WO 2007/099299 A1 | 9/2007 |

OTHER PUBLICATIONS

Nortec Inc., Web Page, SAM-e—Short Absorption Manifold—Submittal Drawings, Printed May 21, 2007, pp. 1-26.

(Continued)

*Primary Examiner* — Robert A Hopkins
(74) *Attorney, Agent, or Firm* — Merchant & Gould PC

(57) ABSTRACT

A steam dispersion system is disclosed. The steam dispersion system includes a header and a mounting plate spaced from the header. A steam dispersion tube including a first end and a second end and an interior cavity defined between the first end and the second end is mounted between the mounting plate and the header. The steam dispersion tube defines a longitudinal axis. A biasing structure is mounted between the mounting plate and the header, wherein the biasing structure applies a biasing force on the steam dispersion tube along a direction parallel to the longitudinal axis of the steam dispersion tube when mounted between the header and the mounting plate.

21 Claims, 8 Drawing Sheets

(56) References Cited

U.S. PATENT DOCUMENTS

| | | | | |
|---|---|---|---|---|
| 5,372,753 | A | 12/1994 | Morton | |
| 5,376,312 | A | 12/1994 | Morton et al. | |
| 5,516,466 | A | 5/1996 | Schlesch et al. | |
| 5,525,268 | A | 6/1996 | Reens | |
| 5,543,090 | A * | 8/1996 | Morton et al. | 261/118 |
| 6,065,740 | A | 5/2000 | Morton | |
| 6,092,794 | A | 7/2000 | Reens | |
| 6,227,526 | B1 | 5/2001 | Morton | |
| 6,378,562 | B1 | 4/2002 | Noone et al. | |
| 6,398,196 | B1 | 6/2002 | Light et al. | |
| 6,485,537 | B2 | 11/2002 | Brilmaker | |
| 6,488,219 | B1 | 12/2002 | Herr | |
| 6,631,856 | B2 | 10/2003 | Herr | |
| 6,824,127 | B2 | 11/2004 | Park et al. | |
| 7,048,958 | B2 | 5/2006 | de Jong et al. | |
| 7,150,100 | B2 | 12/2006 | Tase et al. | |
| 7,744,068 | B2 | 6/2010 | Lundgreen et al. | |
| 2001/0045674 | A1 | 11/2001 | Herr | |
| 2002/0089075 | A1 | 7/2002 | Light et al. | |
| 2002/0163092 | A1 | 11/2002 | Park et al. | |
| 2004/0026539 | A1 | 2/2004 | Herr | |
| 2004/0182855 | A1 | 9/2004 | Centanni | |
| 2005/0212152 | A1 | 9/2005 | Reens | |
| 2008/0290533 | A1 | 11/2008 | Dovich et al. | |

OTHER PUBLICATIONS

Zotefoams Inc., Zotek® F—High Performance PVDF Foams (for Buildings and Construction)—"Taking foam technology to a new level," pp. 1-2, Oct. 2009.

Zotefoams Inc., Zotek® F—High Performance PVDF Foams (for Aviation and Aerospace)—"Taking foam technology to a new level," pp. 1-4, Oct. 2009.

Zotefoams Inc., Zotek® F—High Performance PVDF Foams—"Taking foam technology to a new level," pp. 1-4, Oct. 2009.

Zotefoams Inc., Zotek® F—High Performance PVDF Foams (New Light Weight Materials—Inspiration for Design Innovation)—"Taking foam technology to a new level," pp. 1-6, Date Printed: Dec. 23, 2008.

* cited by examiner

QUICK-ATTACH STEAM DISPERSION TUBES AND METHOD OF ATTACHMENT

TECHNICAL FIELD

The principles disclosed herein relate generally to the field of steam dispersion humidification. More particularly, the disclosure relates to a steam dispersion system including quick attach and detach steam dispersion tubes and methods of attachment thereof.

BACKGROUND

There are a number of different known configurations for steam dispersion humidification systems. One known configuration utilizes a plurality of closely spaced steam dispersion tubes with steam dispersion nozzles for emitting steam. The plurality of steam dispersion tubes extend across the air duct and provide humidification steam to air flowing therethrough.

The plurality of steam dispersion tubes may extend from a central steam manifold such as a header. In certain configurations, the steam dispersion tubes may extend from a header at one end and be attached to the duct wall at the other end, usually through a bracket or a frame. In certain other configurations, the steam dispersion tubes may be positioned between two headers supplying steam to the tubes.

In most conventional systems, attachment of the steam dispersion tubes, either to the header(s), or to the duct, may be a cumbersome and a time-consuming process, requiring many steps, a large number of parts and tools.

For example, in one conventional method of attachment, holes are first drilled into a header wall. Lengths of tubing are cut into short stubs (e.g., 3 inch stubs). The stubs are aligned with the holes drilled into the header and welded at each stub-to-header joint. The walls of the header might warp from the heat caused by the welding, and, thus, might need to be straightened out. Once the stubs are welded onto the header, either a plastic coupling piece or a hose cuff (i.e., a short piece of hose, for example, 2 inches in length) is slid over each of the stubs. The plastic couplings may be shaped in an inner diameter portion thereof to seat a number of sealing structures such as O-rings, gaskets, etc., to provide a seal with outer diameter of the stubs. The plastic couplings may be friction-fitted onto the stubs. In the case of hose cuffs, hose clamps may be used.

The elongate steam dispersion tubes are slid into the other end of the plastic couplings or the hose cuffs and are sealed with sealing structures such as O-rings, gaskets, etc. Again, a friction fit for the plastic couplings or hose clamps for the hose cuffs may be used for attachment.

In a single header system, the other end of the steam dispersion tubes may be attached to the duct wall through a frame or a bracket. A cap may be welded to the other end of the steam dispersion tube. A nut may be welded to the cap. From thereon, a bolt and a L-bracket may be used to attach the end of the steam dispersion tube to the duct wall.

As described above, conventional spring dispersion tube attachment techniques are cumbersome, time-consuming, and require a large number parts and tools. The lengths of the parts including the stubs and the dispersion tubes have to be cut accurately to provide for correct fitment. Thermal expansion of the parts may lead to failure of the seal joints. Moreover, if the tubes need replacing, detachment thereof may be as cumbersome as their attachment.

Other attachment methods providing convenient and quick mounting of steam dispersion tubes to a steam dispersion system, while providing strong seals, are desired.

SUMMARY

The principles disclosed herein relate to a steam dispersion tube that is configured for quick attachment and detachment of the tube to and from steam dispersion systems. A steam dispersion system utilizing a biasing structure configured to provide a biasing force along the longitudinal axis of the steam dispersion tube when the tube is mounted to a steam dispersion system is also described. Methods of attachment and detachment of steam dispersion tubes is also described.

According to one particular aspect, the disclosure is directed to a steam dispersion tube including a header and a mounting plate spaced from the header, wherein a steam dispersion tube including a first end and a second end and an interior cavity defined between the first end and the second end is mounted between the mounting plate and the header. The steam dispersion tube defines a longitudinal axis. A biasing structure is mounted between the mounting plate and the header, wherein the biasing structure applies a biasing force on the steam dispersion tube along a direction parallel to the longitudinal axis of the steam dispersion tube when mounted between the header and the mounting plate.

A variety of additional inventive aspects will be set forth in the description that follows. The inventive aspects can relate to individual features and combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
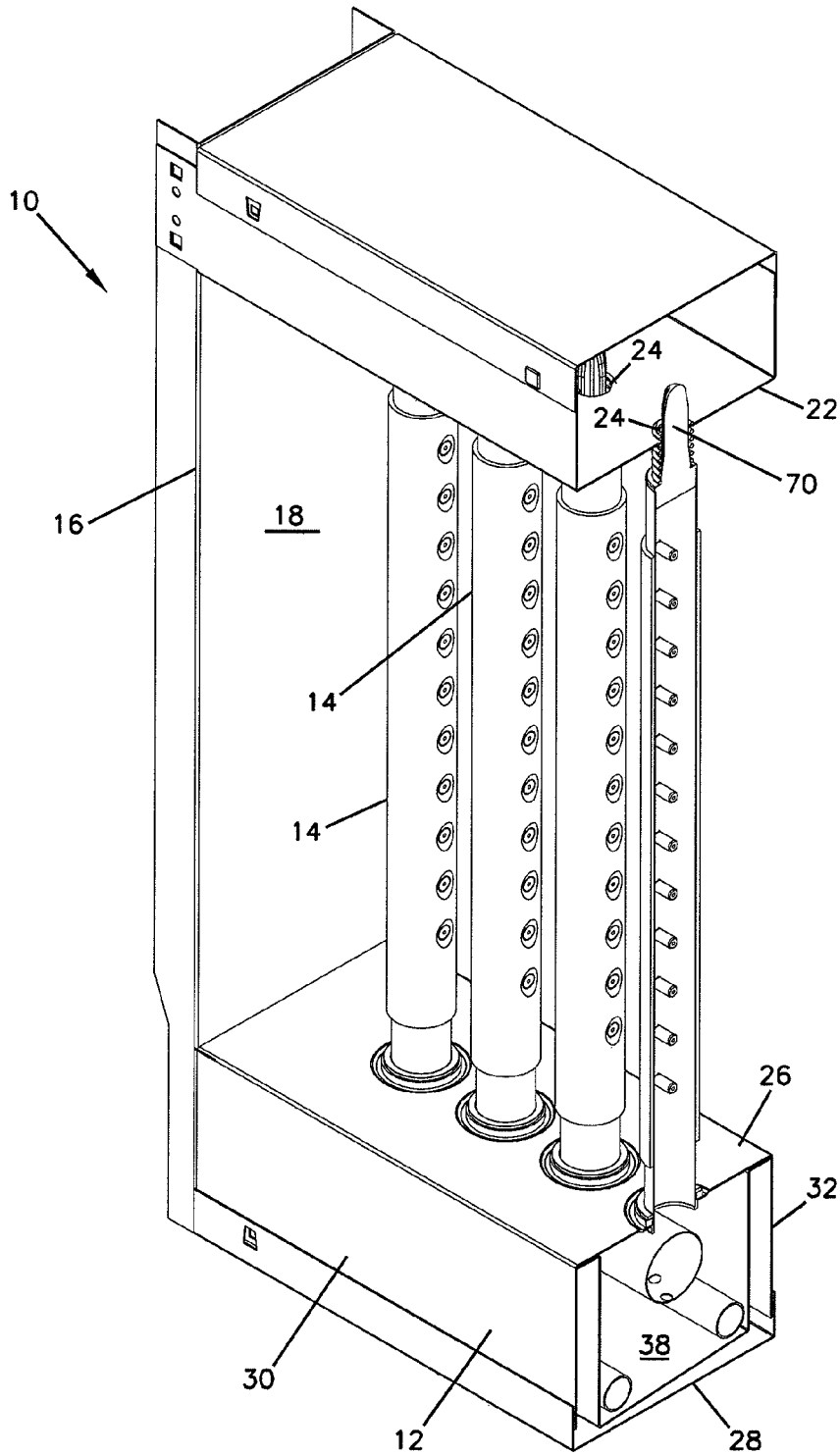
FIG. 1 is a perspective view of a portion of a steam dispersion system having features that are examples of inventive aspects in accordance with the principles of the present disclosure, portions of the steam dispersion system have been cut-away to illustrate certain internal features thereof.
Figure 2:
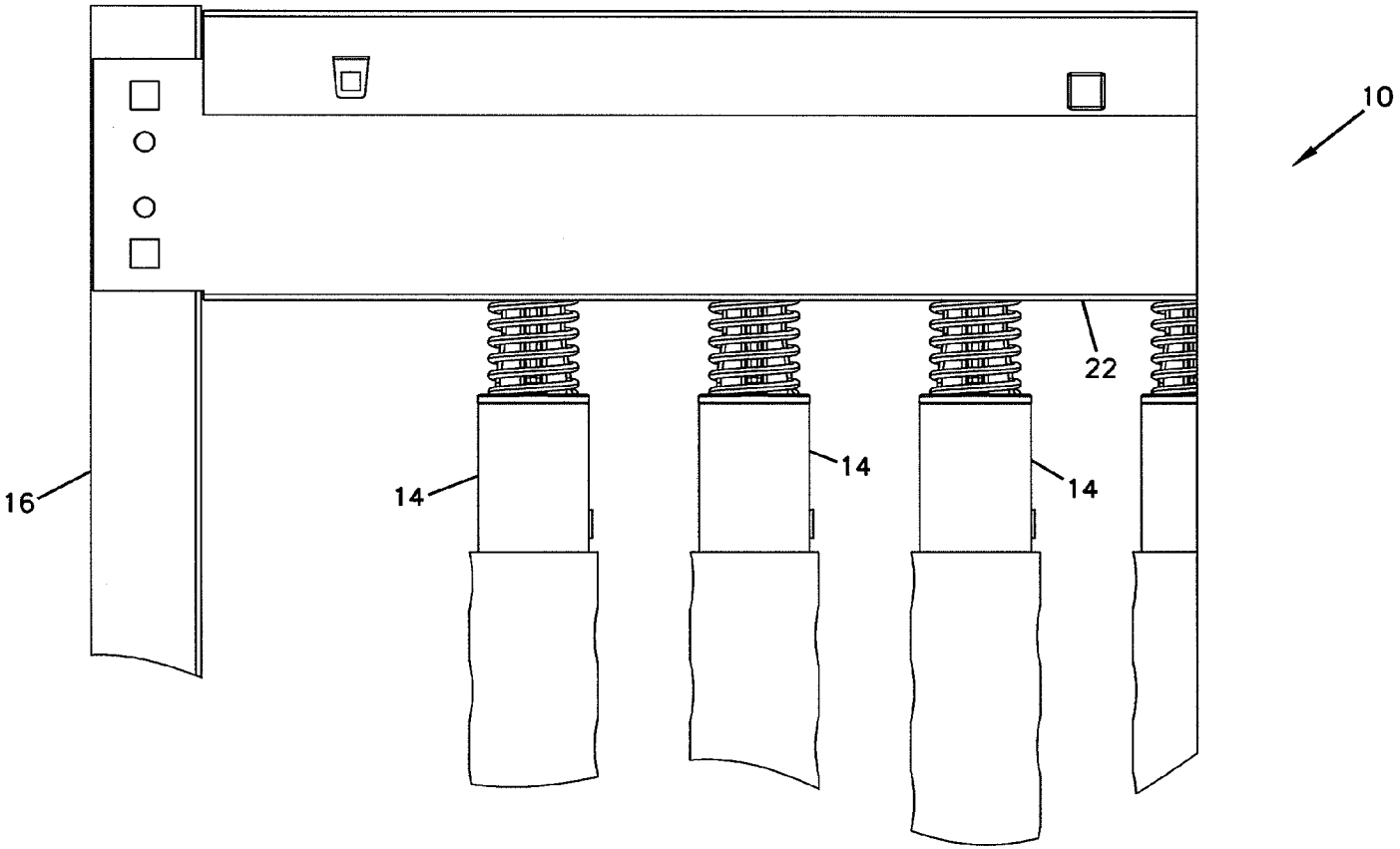
FIG. 2 is a front view of the steam dispersion system of FIG. 1.
Figure 3:
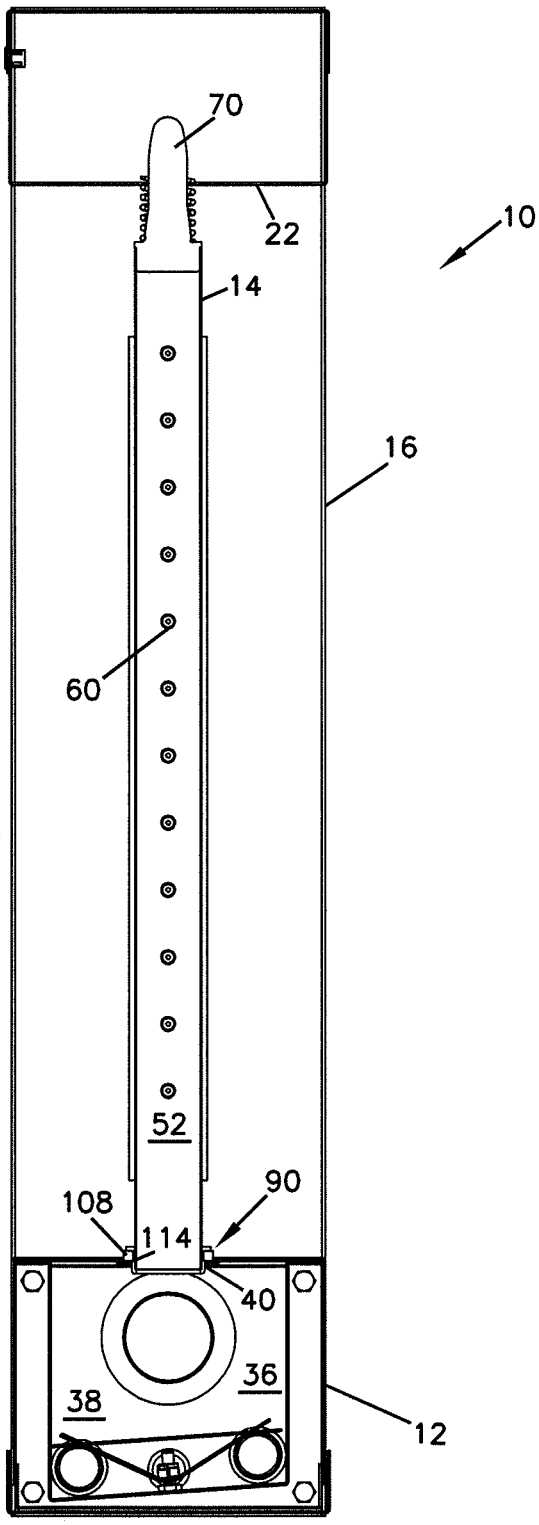
FIG. 3 illustrates the steam dispersion system of FIG. 1 from a side view.

FIGS. 1-6 illustrate a steam dispersion system 10 having features that are examples of inventive aspects in accordance with the principles of the present disclosure. In the depicted embodiment, the steam dispersion system 10 includes a steam manifold (or chamber) in the form of a header 12 with a plurality of steam dispersion tubes 14 extending from the header 12. The header 12 receives humidification steam from a steam source (e.g., a boiler, an electric humidifier, a gas humidifier, etc.) and distributes the steam pressure evenly among the tubes 14 protruding therefrom. The steam tubes 14 coming out of the header 12 disperse the steam to the atmosphere at generally atmospheric pressure.

In the depicted embodiment, the steam dispersion system 10 is a single header system, wherein the dispersion tubes 14 extend from a single header 12. The tubes 14 are attached at the other end to a portion of a frame structure 16 supporting the dispersion system 10. Other configurations of steam dispersion systems can be provided according to the inventive features of the present disclosure.

The frame structure 16 depicted includes a first sidewall 18, a second sidewall (not shown in the Figures), and a top wall 22. The first and second sidewalls are attached to the header 12 and the top wall 22 is spaced from the header 12 and extends between the sidewalls. The top wall 22 defines a plurality of openings 24 that are configured to removably receive ends of the steam dispersion tubes 14, as will be described in further detail below.

In certain embodiments, the frame structure 16 may be mounted to a duct wall. In other embodiments, the steam dispersion system 10 may be a free-standing system. In addition, even though in the depicted embodiment, the steam dispersion tubes 14 are vertically oriented, in other embodiments, the dispersion system 10 and the tubes 14 may be oriented in other directions. The illustrated system 10 is simply one example system provided to illustrate and describe the inventive features of the disclosure and should not be used to limit the inventive features described herein.

The header 12, as depicted, includes a top wall 26, a bottom wall 28, a front wall 30, a rear wall 32, a right sidewall (not shown in the Figures), and a left sidewall 36, cooperatively defining an interior 38. In the depicted embodiment, the header 12 includes generally a rectangular cross-sectional shape, wherein the top wall 26, the bottom wall 28, the front wall 30, the rear wall 32, the right sidewall, and the left sidewall 36 are generally planar, defining substantially right angles thereinbetween. In other embodiments, the header 12 may be of other shapes such as round.

The steam dispersion tubes 14 shown herein extend from openings 40 formed on the top wall 26 of the header 12. As noted above, the tubes 14 are attached at their other ends to the top wall 22 of the frame structure 16.

Figure 6:
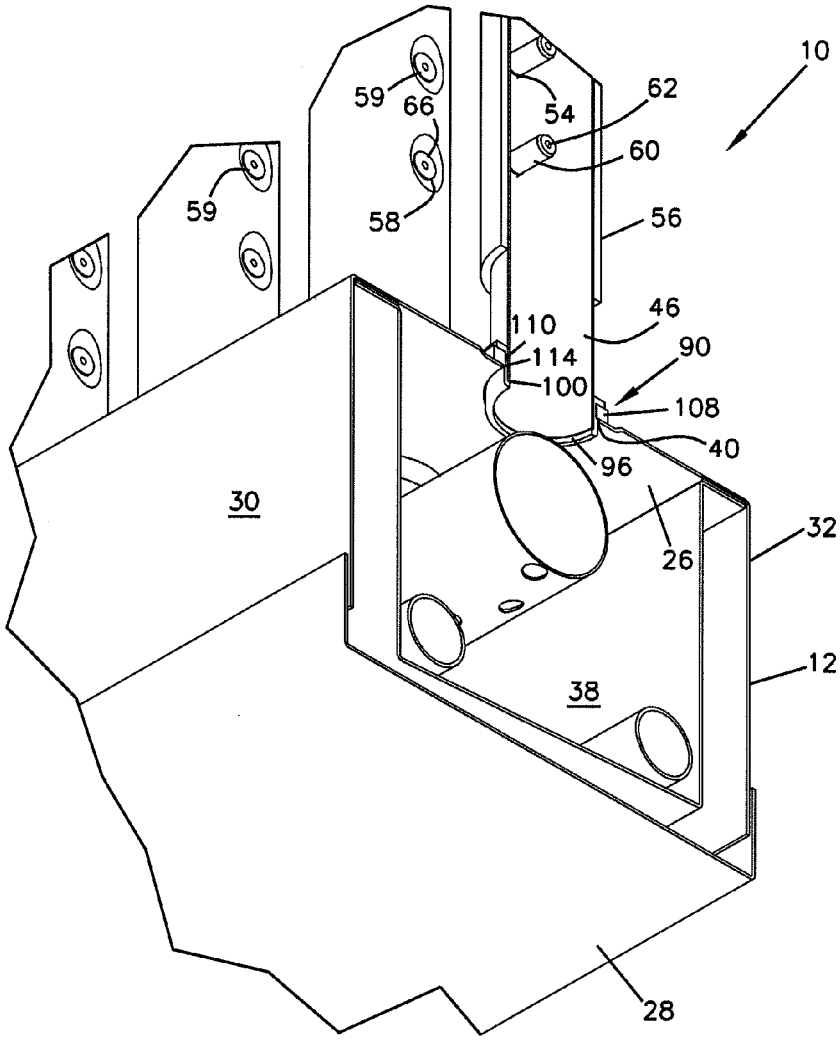
FIG. 6 illustrates another perspective view of the lower ends of the steam dispersion tubes of FIG. 5.
Figure 7:
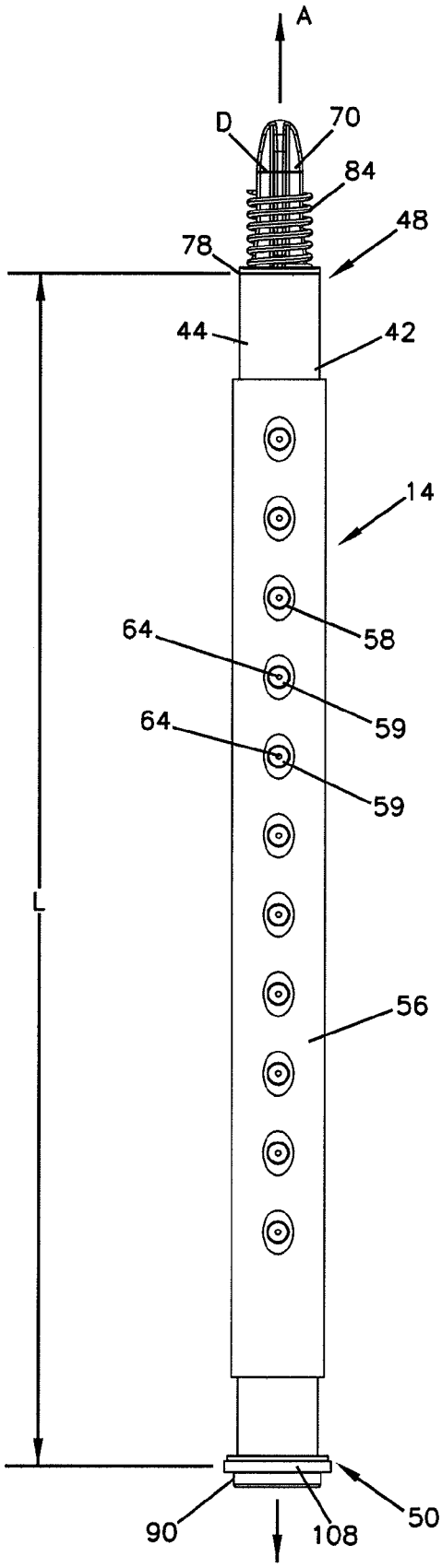
FIG. 7 is a side view of the steam dispersion tube having features that are examples of inventive aspects in accordance with the principles of the present disclosure.

An example embodiment of a steam dispersion tube 14 having features that are examples of inventive aspects in accordance with the principles of the present disclosure is shown in FIG. 7. The steam dispersion tube 14, includes a generally cylindrical wall 42 defining an outer surface 44 and an inner surface 46 (see FIG. 6) extending from a first end 48 to the second end 50. In other embodiments, the steam dispersion tube 14 may be of other shapes, such as square, triangular, elliptical etc. Also, in other embodiments, the steam dispersion tube 14 may be formed from multiple pieces that are attached together to form the tube. The steam dispersion tube 14 defines a longitudinal axis A.

The steam dispersion tube 14 defines a hollow interior 52 for carrying steam. The steam dispersion tube 14 includes a plurality of openings 54 through the cylindrical wall 42 for emitting the steam. As depicted, the outer surface 44 of the cylindrical wall 42 may be covered with insulation 56. The insulation 56 may define a plurality of openings 58 through the insulation 56 that are aligned with the openings 54 of the steam dispersion tube 14. A material that may be suitable for the insulation 56 will preferably be one that meets 25/50 flame/smoke indexes for UL723/ASTM E-84, making it acceptable for use in air ducts/plenums. It has also been found that a material that is suitable for the insulation 56 should preferably be a good insulator, having a low thermal conductivity, preferably, less than about 0.35 Watts/m-K (2.4 in-hr/$ft^2$ deg F.). One such material that has been identified to meet the above-listed criteria is polyvinylidene fluoride (i.e., PVDF) fluoropolymer. Please refer to U.S. patent application Ser. No. 11/521,083, filed Sep. 13, 2006, entitled "INSULATION FOR A STEAM CARRYING APPARATUS AND METHOD OF ATTACHMENT THEREOF", for further description of a number of insulation materials suitable for the steam dispersion system 10, the entire disclosure of which application is incorporated herein by reference.

As shown in FIGS. 1 and 4-6, the tube 14 includes steam delivery points 59 defined by nozzles 60 (i.e., tubelets) provided in the openings 54. It should be noted that in other embodiments, the steam delivery points 59 may be defined simply by the openings 54 of the tubes 14 without the use of any nozzles.

The nozzles 60, as depicted, are generally cylindrical in shape and project inwardly in a direction from the outer surface 44 to the interior 52 of the steam dispersion tubes 14. Each nozzle 60 defines a throughhole 62 which leads to a steam exit 64. The throughhole 62 is in fluid communication with the hollow interior 52 of the steam dispersion tube 14.

The nozzles 60 may be coupled to the steam dispersion tube 14 by being press-fit into the openings 54. Each nozzle 60 may define a shoulder 66 that abuts against the outer surface 44 of the cylindrical wall 42 of the steam dispersion tube 14.

It should be noted that the nozzles 60 depicted in the embodiment of FIGS. 1-7 is simply one non-limiting example structure for exiting the steam from the dispersion tubes 14. Other structures are certainly possible. For example, in other embodiments, the nozzles may be formed integrally with the cylindrical wall 42 of the steam dispersion tube 14 instead of being removably disposed. In other embodiments, as discussed above, the steam delivery points 58 may be defined simply by the openings 54 of the tubes 14 without the use of any nozzles 60. In yet other embodiments, a steam dispersion tube 14 may include a fine mesh configuration, a porous material, or a woven material defining hundreds, even thousands, of steam delivery points.

Figure 4:
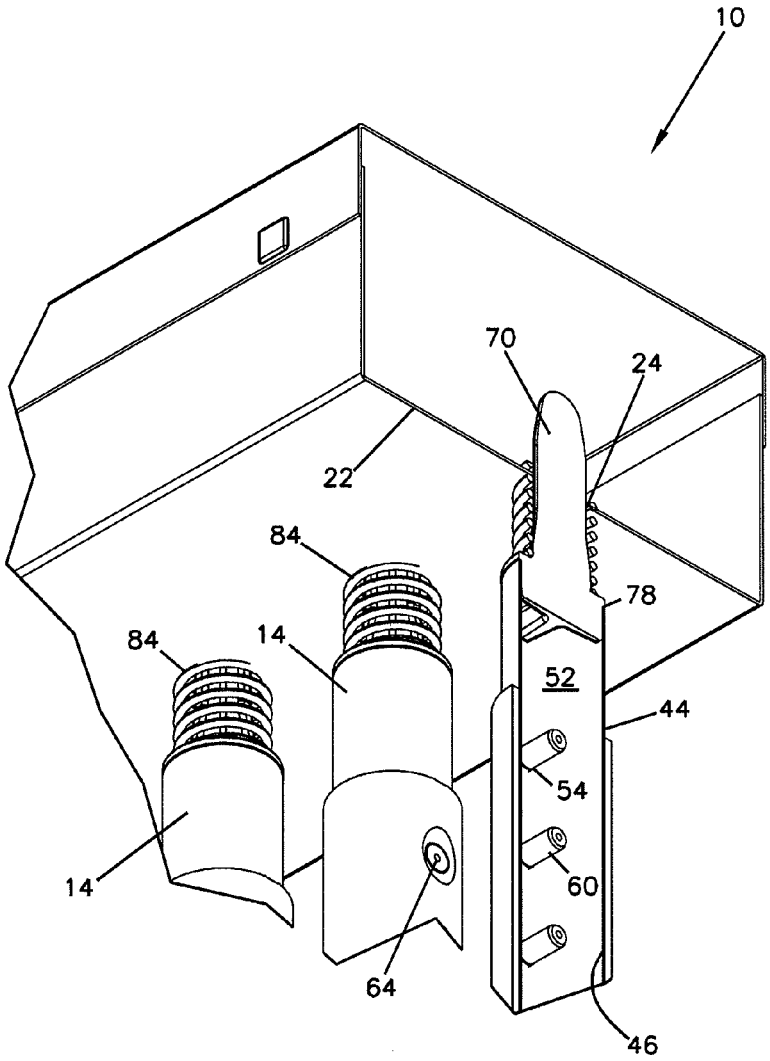
FIG. 4 illustrates a perspective view of the upper ends of a plurality of steam dispersion tubes having features that are examples of inventive aspects in accordance with the principles of the present disclosure mounted to the steam dispersion system of FIG. 1.
Figure 8:
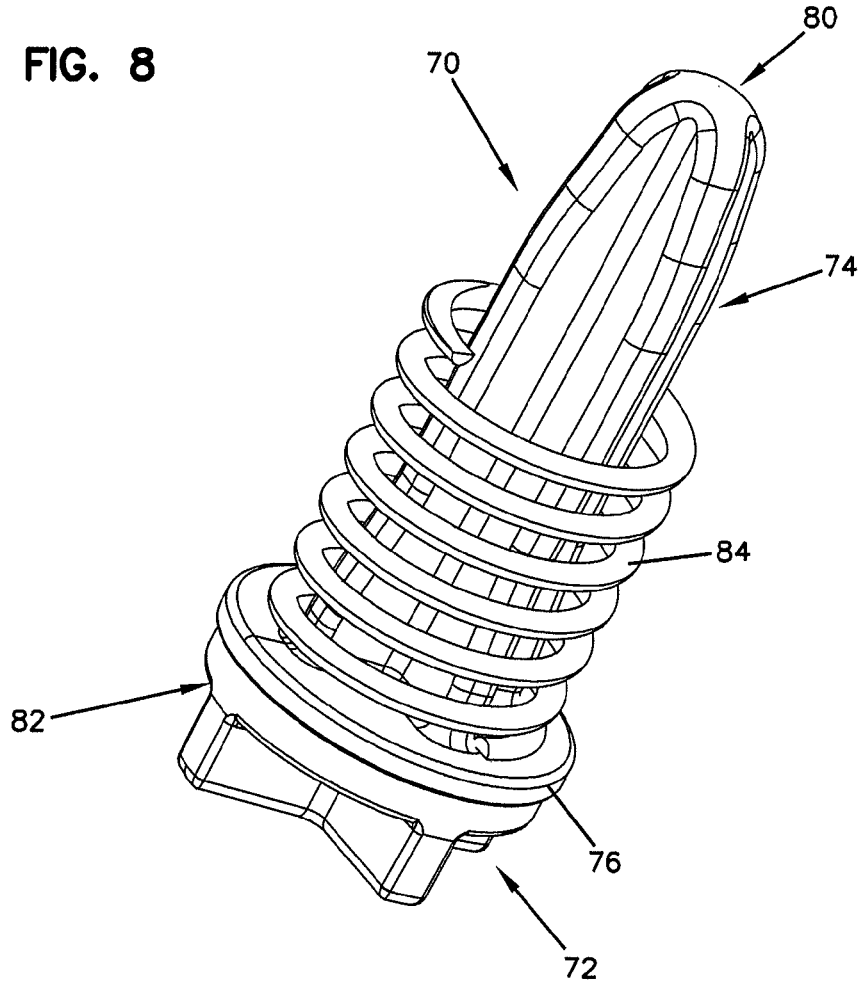
FIG. 8 is a perspective view of a plug and a biasing structure configured for attachment to the upper end of the steam dispersion tube of FIG. 7 for mounting to the steam dispersion system of FIG. 1.

An example attachment technique for attaching the tubes 14 to the steam dispersion system 10 is described in reference to FIGS. 4-9 As shown in FIGS. 4 and 8, according to one example, a plug 70 is provided for attachment to and sealing the first end 48 of the tube 14. The plug 70 may be formed from a polymer or another suitable material for sealing the end of the tube 14. The plug 70 includes a seal portion 72 and a mounting portion 74 with a flange 76 defined thereinbetween. The seal portion 72 is sized to provide a friction fit within the inner surface 46 of the steam dispersion tube 14. The flange 76, in the depicted embodiment, is generally circular and is configured to abut against an edge 78 defined by the first end 48 of the dispersion tube 14 to limit further insertion of the plug 70.

The mounting portion 74 of the plug 70 is generally elongate. The mounting portion 74 is configured to be inserted into an opening for mounting the steam dispersion tube 14 to a steam dispersion system. As discussed previously, the opening may be of a frame top wall 22 or another structure for mounting the steam dispersion tubes 14 onto a steam dispersion system 10. In the depicted embodiment, the mounting portion 74 defines a circular configuration that tapers outwardly going from the upper end 80 of the plug 70 toward the lower end 82, wherein the diameter D of the mounting portion increases as it extends downwardly toward the flange 76.

The mounting portion 74 of the plug 70 is also configured to receive a biasing structure 84. When the steam dispersion tube 14 is mounted to the steam dispersion system 10, the biasing structure 84 is captured between the flange 76 of the plug 70 and the structure defining the mounting opening (e.g., the top wall 22 of the frame 16). In the depicted embodiment, the biasing structure 84 is depicted as a coil-spring. Other types of biasing structures such as dampers, other types of springs, etc. may also be used.

According to the present disclosure, the biasing structure 84 may be any resilient structure that provides a biasing force on the steam dispersion tube 14 along a direction parallel to the longitudinal axis A when the tube 14 is mounted to the system 10.

As shown in FIG. 8, the coil-spring 84 is slid over the mounting portion 74 of the plug 70 from the upper end 80, where the diameter D of the mounting portion 74 is smaller. Adjacent the flange 76 of the plug 70, the diameter D of the mounting portion 74 is increased and is preferably sized to provide a snug friction fit with the coil-spring 84 to lock the spring into place.

It should be noted that the mounting portion 74 of the plug 70 depicted is configured to receive a coil-spring type biasing structure 84. Depending upon the type and the shape of the biasing structure 84 used, the mounting portion 74 can take on other configurations. The depicted embodiment should not be used to limit the inventive features of the present disclosure.

It should also be noted that although in the depicted embodiment, the biasing structure 84 is shown as being attached to the steam dispersion tube 14, in other embodiments, the biasing structure 84 can be attached to other parts of the system 10, such as the top wall 22 of the frame 16. In this manner, the biasing structure 84 may still be compressed against an end 48 of the tube 14 when the plug 70 is being inserted into an opening 24 of the top wall 22 of the frame 16.

In other embodiments, the biasing structure 84 may be located at portions of the dispersion tube 14 other than adjacent an end 48 of the tube 14. For example, in certain embodiments, a coil-spring may be large enough in diameter to go around a portion of the cylindrical wall 42 of the dispersion tube 14 and be compressed against a peripheral flange that may be located at location along the length L of the tube 14. As long as the biasing structure is configured to apply a biasing force on the steam dispersion tube 14 along a direction parallel to the longitudinal axis A of the steam dispersion tube 14 when mounted on the system 10, a number of different configurations can be used.

Although illustrated as being a circular coil-spring, the biasing structure 84 can take on other shapes and forms, such as being square in cross-sectional profile.

Figure 5:
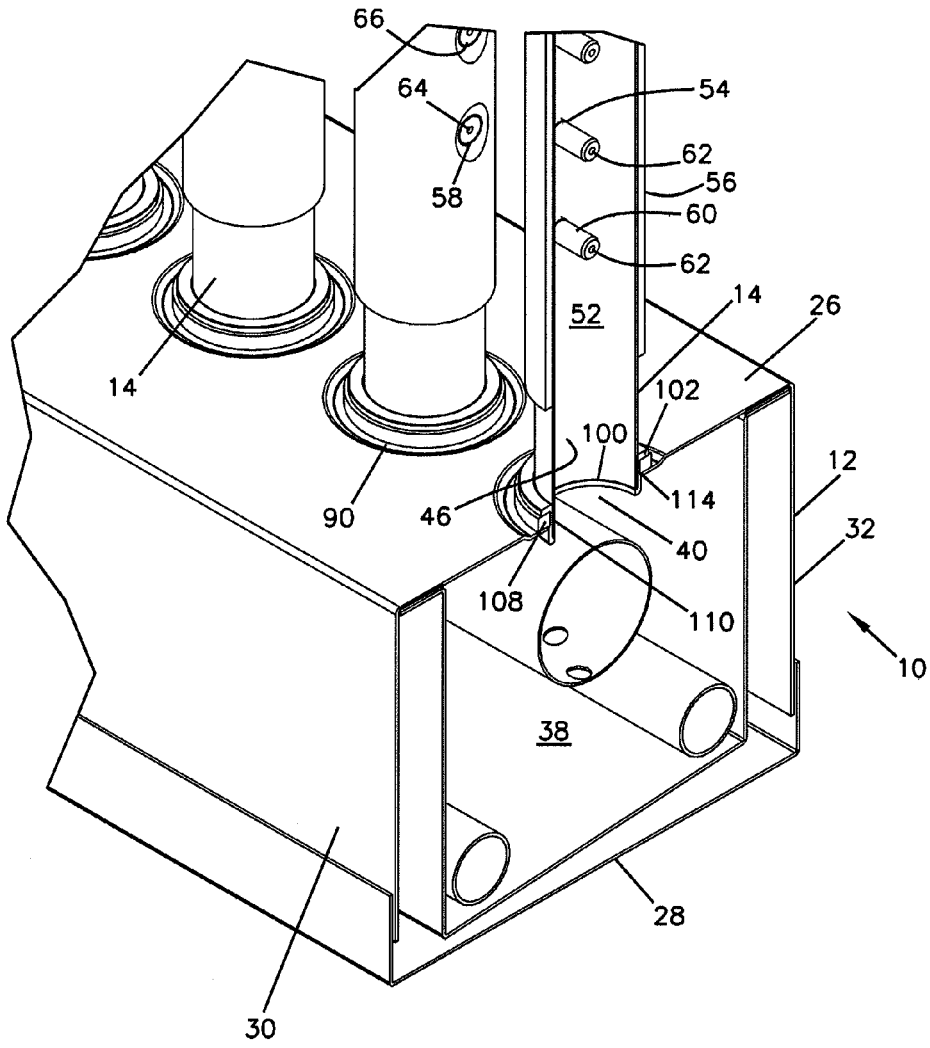
FIG. 5 illustrates a perspective view of the lower ends of the steam dispersion tubes of FIG. 4 mounted to the steam dispersion system of FIG. 1.
Figure 9:
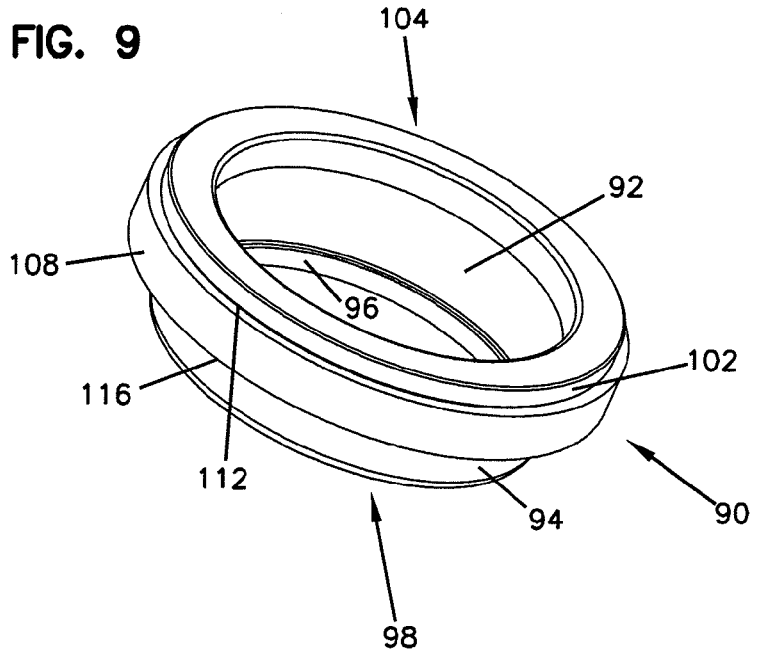
FIG. 9 is a perspective view of a fitting configured for attachment to the lower end of the steam dispersion tube of FIG. 7 for mounting to the steam dispersion system of FIG. 1.

Now referring to FIGS. 5, 6, and 9, for mounting the second end 50 of the steam dispersion tube 14 into an opening 40 formed on the header 12, a circular fitting 90 may be used. In one embodiment, the fitting 90 may be made out of metal (e.g., aluminum).

The fitting 90 is shown in further detail in FIG. 9. As depicted, the fitting 90 includes an inner surface 92 and an outer surface 94. The diameter of the inner surface 92 of the fitting 90 is sized to receive the outer surface 44 of the dispersion tube 14 with a friction fit. The inner surface 92 of the fitting 90 defines a radially inwardly protruding lip 96 adjacent a lower end 98 of the fitting 90. The lip 96 is configured to contact an edge 100 defined by the second end 50 of the steam dispersion tube 14 to stop further insertion thereof.

The outer surface 94 of the fitting 90 defines a radially outwardly protruding flange 102 adjacent an upper end 104 of the fitting 90. The flange 102 is configured to abut a surface such as the top wall 26 of a header 12 when the tube 14 is mounted to a steam dispersion system 10 to limit further insertion of the tube 14.

A seal structure 108 may be slidably placed onto the fitting 90 and may be positioned underneath the flange 102. The seal structure 108 is captured between the flange 102 and the top wall 26 of the header 12 when the tube 14 is mounted to the system 10. In the illustrated embodiment, the seal structure 108 is depicted as a gasket having a square cross-sectional profile. Other types of sealing structures 108 (such as O-rings, etc.) may be utilized.

The fitting 90 may define a recess 110 below the flange 102 for seating the seal structure 108. The recess 110 is defined by the flange 102 at an upper end 112 and a second smaller lip 114 at a lower end 116. As noted, when the second end 50 of the steam dispersion tube 14 is mounted to an opening 40 of the header 12, the seal structure 108 is captured between the top wall 26 of the header 12 and the flange 102 of the fitting 90.

In mounting a steam dispersion tube 14 to the steam dispersion system 10, once the plug 70 with the coil-spring 84 and the fitting 90 are frictionally fit to the first and second ends 48, 50, respectively, of the dispersion tube 14, the upper end 48 of the steam dispersion tube 14 is first inserted into an opening 24 formed in the frame 16. The mounting portion 74 of the plug 70 is inserted with the biasing structure 84 being captured between the frame 16 and the flange 76 of the plug 70. Then, the upper end 48 of the tube 14 is pushed toward the frame 16, compressing the biasing structure 84, until the lower end 50 of the tube 14 (with the fitting 90 mounted thereon) can be inserted into an opening 40 in the header 12. When the second end 50 is inserted, the seal structure 108 is captured between the flange 102 of the fitting 90 and the top wall 26 of the header 12. The downward biasing force of the biasing structure 84 ensures a good seal between the fitting 90 and the header opening 40 by compressing the seal structure 108 against the top wall 26 of the header 12.

If a steam dispersion tube 14 needs to be removed from the system 10, the upper end 48 of the tube 14 is first pushed upwardly toward the frame 16, compressing the biasing structure 84, until the lower end 50 of the tube 14 (with the fitting 90 thereon) can be lifted out of the header opening 40 for removal.

It should be note that the sealing technique described herein for sealing the second end 50 of the tube 14 to the header 12 is simply one example configuration and should not be used to limit the inventive features of the disclosure.

The steam dispersion tube 14 of the present disclosure and the mounting method thereof provides a number of advantages over conventional mounting configurations and techniques.

The method of the present disclosure enables rapid installation and removal of the dispersion tubes 14, with essentially no tools. The present method of attachment accommodates tolerance stack-up of components, ensuring that the dispersion tubes 14 consistently fit into the frame 16 of the steam dispersion system 10. The present method of attachment accommodates for thermal expansion of the dispersion tubes 14 and/or other parts of the dispersion system 10, such as the header 12.

The biasing structure 84 of the present system 10 accommodates any vertical displacement between parts of the system 10. The biasing structure 84 is positioned and configured such that it can either continuously take up any slack or allow for expansion. For example, a continuous downward force is provided on the seal structure 108 to compress it against the header top wall 26, forming a strong seal with the opening 40 in the header 12. Also, since the header steam chamber might be pressurized (e.g., up to 8" $H_20$, 0.29 psi, or 42 lbs/ft$^2$), the biasing structure 84 can accommodate an upward force that might be created by the displacement of the header top wall 26.

The continuous downward force provided by the biasing structure 84 may also help seal any features within the header chamber to the header top wall 26. For example, in a system that includes a header 12 that is divided into more than one chamber with a header divider, the downward force of the biasing structure 84 against the top wall 26 of the header 12 can compress any sealing features on the header divider against the bottom face of the header top wall 26, ensuring a tight seal between the two or more chambers. Please see U.S. patent application Ser. No. 11/804,991, filed Aug. 20, 2007, entitled "DEMAND ACTIVATED STEAM DISPERSION SYSTEM", for an example steam dispersion system utilizing a header that is divided into more than one chamber, the entire disclosure of which application is incorporated herein by reference. In such a system, a first plurality of steam dispersion tubes may communicate with one chamber while a second plurality of steam dispersion tubes communicate with the other chamber. The first or the second pluralities of tubes may be selectively turned on or off depending upon the humidification demand needed.

Further advantages of the mounting method of the present disclosure includes the possible elimination of parts such as tube stubs, plastic couplings, hose cuffs, large number of sealing structures, etc. Elimination of these parts may lead to reduction in costs for installation. Processes such as drilling, welding, header wall straightening, coupling installation, and O-ring installation may be limited or eliminated. Assembly time may be reduced.

With the mounting method of the present disclosure, the second end 50 of the dispersion tube 14, with the fitting 90 mounted thereon, protrudes into the interior 38 of the header 12, versus being butted up as a stub in the conventional techniques. This might ensure that all condensate formed within the tube 14 falls into the header 12 without having to rely upon O-ring seals of plastic couplings used in conventional methods of attachment. Risks of torn O-ring material dislodging and fouling structures such as traps within the header 12 might be reduced or eliminated with the attachment method of the present disclosure.

Although in the foregoing description of the steam dispersion system 10, terms such as "top", "bottom", "above", "below", "upward", and "downward" may have been used for ease of description and illustration, no restriction is intended by such use of the terms. The steam dispersion system 10 described herein can be used in any orientation within a duct.

The above specification, examples and data provide a complete description of the manufacture and use of the composition of the inventive features of the disclosure. Since many embodiments of the inventive aspects of the disclosure can be made without departing from the spirit and scope of the disclosure, the inventive aspects reside in the claims hereinafter appended.

We claim:

1. A steam dispersion system comprising:

a header defining a steam chamber, the header including an opening communicating with an exterior of the header;

a mounting plate spaced from the header;

a steam dispersion tube including a first end and a second end and an interior cavity defined between the first end and the second end, the steam dispersion tube defining a longitudinal axis, wherein the first end of the steam dispersion tube is mounted to the mounting plate and the second end of the steam dispersion tube is mounted to the header such that the opening of the header is in fluid communication with the interior cavity of the steam dispersion tube, the steam dispersion tube defining at least one opening for dispensing steam to an exterior of the steam dispersion tube when mounted between the header and the mounting plate; and a biasing structure positioned between the mounting plate and the header and axially aligned with the longitudinal axis of the steam dispersion tube.

2. A steam dispersion system according to claim 1, wherein the biasing structure is located between the first end of the steam dispersion tube and the mounting plate.

3. A steam dispersion system according to claim 1, wherein the biasing structure is a coil-spring.

4. A steam dispersion system according to claim 1, wherein the steam dispersion tube is removably mounted to the mounting plate and the header such that the steam dispersion tube can be mounted or removed by compressing the biasing structure.

5. A steam dispersion system according to claim 1, wherein the steam dispersion tube includes a plug sealing the first end of the steam dispersion tube and the biasing structure mounted to the plug, wherein the plug is removably inserted into an opening formed in the mounting plate and the biasing structure becomes positioned between the first end of the steam dispersion tube and the mounting plate when the steam dispersion tube is mounted between the mounting plate and the header.

6. A steam dispersion tube according to claim 5, wherein the steam dispersion tube includes a flange adjacent the second end, wherein the steam dispersion tube is removably mounted to the opening of the header with a seal structure captured between the flange and the header, the seal structure compressed by a compression force provided by the biasing structure when the steam dispersion tube is mounted.

7. A steam dispersion tube according to claim 6, wherein a portion of the steam dispersion tube protrudes into the steam chamber of the header when the steam dispersion tube is removably mounted between the header and the mounting plate.

8. A steam dispersion tube according to claim 1, wherein the mounting plate is part of a frame structure configured to support a plurality of steam dispersion tubes extending between the mounting plate and the header.

9. A method of attaching a steam dispersion tube to a steam dispersion system, the method comprising:

providing a header defining a steam chamber, the header including an opening communicating with an exterior of the header;

providing a mounting plate at a first distance from the header;

providing a steam dispersion tube including a first end and a second end and an interior cavity defined between the first end and the second end, the steam dispersion tube defining at least one opening for dispensing steam to an exterior of the steam dispersion tube;

mounting the first end of the steam dispersion tube to the mounting plate;

inserting the second end of the steam dispersion tube into the opening of the header; and placing a biasing structure at a location between the mounting plate and the header in line with a longitudinal axis of the steam dispersion tube.

10. A method according to claim 9, further comprising providing the biasing structure between the first end of the steam dispersion tube and the mounting plate.

11. A method according to claim 10, further comprising removing the steam dispersion tube from the steam dispersion system by pushing the steam dispersion tube against the mounting plate to compress the biasing structure against the mounting plate and lifting the second end of the steam dispersion tube out of the opening of the header.

12. A method according to claim 10, further comprising inserting a plug into the first end of the steam dispersion tube to seal the first end thereof and placing the biasing structure on the plug.

13. A method according to claim 12, further comprising providing an opening in the mounting plate and inserting a portion of the plug into the opening of the mounting plate with the biasing structure positioned between the first end of the steam dispersion tube and the mounting plate.

14. A method according to claim 9, wherein the biasing structure is a coil-spring.

15. A method according to claim 9, further comprising mounting a plurality of steam dispersion tubes between the mounting plate and the header.

16. A method according to claim 9, further comprising placing a seal structure between the steam dispersion tube and the opening of the header.

17. A steam dispersion tube comprising:

a first end and a second end and an interior cavity defined between the first end and the second end;

at least one steam dispersion opening located between the first end and the second end for dispensing steam to an exterior of the steam dispersion tube;

a plug sealing the first end, the plug defining an elongate portion;

a biasing structure placed on the plug, wherein the biasing structure is configured to compress against the first end of the steam dispersion tube when the elongate portion of the plug is inserted into an opening in a steam dispersion system.

18. A steam dispersion tube according to claim 17, further comprising a radially outwardly extending flange adjacent the second end.

19. A steam dispersion tube according to claim 18, further comprising a seal structure located underneath the flange between the second end of the steam dispersion tube and the flange.

20. A steam dispersion tube according to claim 17, further comprising a plurality of steam dispersion openings located between the first end and the second end for dispensing steam to an exterior of the steam dispersion tube.

21. A steam dispersion system comprising:

a header defining a steam chamber, the header including an opening communicating with an exterior of the header;

a mounting plate spaced from the header;

a steam dispersion tube including a first end and a second end and an interior cavity defined between the first end and the second end, the steam dispersion tube defining a longitudinal axis, wherein the first end of the steam dispersion tube is mounted to the mounting plate and the second end of the steam dispersion tube is mounted to the header such that the opening of the header is in fluid communication with the interior cavity of the steam dispersion tube, the steam dispersion tube defining at least one opening for dispensing steam to an exterior of the steam dispersion tube when mounted between the header and the mounting plate; and a biasing structure mounted between the mounting plate and the header, wherein the biasing structure applies a biasing force on the steam dispersion tube along a direction parallel to the longitudinal axis of the steam dispersion tube when mounted between the header and the mounting plate.

* * * * *